US008251659B2

(12) United States Patent
Tisenchek et al.

(10) Patent No.: US 8,251,659 B2
(45) Date of Patent: Aug. 28, 2012

(54) INSERT FOR THROUGH-HOLES AND METHOD THEREFOR

(75) Inventors: Nicholas Tisenchek, Clifton Park, NY (US); Frederick George Baily, Ballston Spa, NY (US); John Matthew Sassatelli, Valley Falls, NY (US); James Royce Howes, Hermon, ME (US)

(73) Assignee: General Electric Company, Schenectady, NY (US)

( * ) Notice: Subject to any disclaimer, the term of this patent is extended or adjusted under 35 U.S.C. 154(b) by 874 days.

(21) Appl. No.: 12/323,555

(22) Filed: Nov. 26, 2008

(65) Prior Publication Data

US 2010/0129230 A1 May 27, 2010

(51) Int. Cl.

| | |
|---|---|
| ***F01D 5/18*** | (2006.01) |
| ***B64C 11/24*** | (2006.01) |
| ***B63H 1/14*** | (2006.01) |
| ***B63H 1/28*** | (2006.01) |

(52) U.S. Cl. ..... 416/91; 416/1; 416/96 R; 416/244 B; 416/245 A

(58) Field of Classification Search ..... 416/1, 91, 416/96 R, 244 B, 245 A; 16/2.1, 2.2; 174/135, 174/152 G, 153 G See application file for complete search history.

(56) References Cited

U.S. PATENT DOCUMENTS

| | | | | |
|---|---|---|---|---|
| 3,792,938 | A * | 2/1974 | Wilde | 416/245 A |
| 6,043,432 | A * | 3/2000 | Gretz | 174/668 |
| 7,100,264 | B2 * | 9/2006 | Skinner et al. | 29/523 |
| 2006/0104811 | A1 * | 5/2006 | Montgomery | 416/1 |
| 2007/0258813 | A1 * | 11/2007 | Klutz | 416/90 R |

* cited by examiner

*Primary Examiner* — Michelle Mandala

(74) *Attorney, Agent, or Firm* — Ernest G. Cusick; Gary M. Hartman; Domenica N. S. Hartman

(57) ABSTRACT

An insert and method for altering a through-hole in a body, such as a steam balance hole in a steam turbine rotor wheel. The insert has a body with oppositely-disposed first and second ends, a flange radially extending from the second end of the body, and an outer surface at a perimeter of the body between the first end and the flange. A first bore within the body defines a first opening at the first end, and the first bore and outer surface of the body cooperate to define therebetween a wall capable of being plastically deformed in a radially outward direction. A second bore within the body communicates with the first bore and has a smaller cross-section than the first bore. The installation method entails installing the insert in a through-hole and flaring the wall to clamp the axial thickness of the body between the flange and flared wall of the insert.

19 Claims, 3 Drawing Sheets

INSERT FOR THROUGH-HOLES AND METHOD THEREFOR

BACKGROUND OF THE INVENTION

The present invention generally relates to inserts and methods for plugging or altering the orifice size of a through-hole, and more particularly steam balance holes in steam turbine wheels.

Rotor wheels of steam turbines are often equipped with balance holes through which steam leakage across the stationary nozzles of the turbine passes from stage to stage. The design intent of balance holes in an impulse stage design is to prevent leakage from reentering the main steam path through the turbine, avoiding disturbances in the main steam path that would lead to significant losses. The number and diameters of the balance holes are important, in that some of the leakage will reenter the main steam path if the aggregate cross-sectional area of the holes is insufficient for a given stage, while steam will be drawn from the main steam path into the leakage flow if the aggregate cross-sectional area is excessive for the stage.

Ongoing improvements in bucket, nozzle, and nozzle seal designs have reduced leakage flow, necessitating the use of fewer and/or smaller balance holes to maintain efficient operation of steam turbines. Because of the materials and costs involved in manufacturing steam turbine rotors (including their wheel and shafts), it is preferred to modify rather than replace rotors during retrofitting of a steam turbine. As disclosed in U.S. Pat. No. 7,134,841 to Montgomery, assigned to the assignee of the current application, a device can be installed in the steam balance holes of a steam turbine wheel to adjust and optimize the balance hole area during a steam turbine retrofit. While effective, further improvements would be desirable.

BRIEF DESCRIPTION OF THE INVENTION

The present invention provides an insert and method suitable for altering a through-hole, such as a steam balance hole in a steam turbine rotor wheel.

According to a first aspect of the invention, the insert comprises a body having a longitudinal axis, oppositely-disposed first and second ends, a flange radially extending from the second end of the body, and an outer surface at a perimeter of the body between the first end and the flange at the second end of the body. A first bore within the body defines a first opening at the first end of the body, and the first bore and the outer surface of the body cooperate to define therebetween a wall capable of being plastically deformed in a radially outward direction. A second bore within the body communicates with the first bore and has a smaller cross-section than the first bore. In addition to the insert, another aspect of the invention encompasses a steam turbine rotor wheel having a steam balance hole in which the insert is installed.

Another aspect of the invention is a method of installing an insert in a through-hole, such as a steam balance hole of a steam turbine rotor wheel. The method generally entails placing the insert in the through-hole so that a first end of the insert protrudes from a first side of the wheel and a flange radially extending from an oppositely-disposed second end of the insert abuts an oppositely-disposed second side of the wheel. A shaft is then inserted in a first bore within the body that defines a first opening at the first end of the body and in a second bore within the body having a smaller cross-section than the first bore. The insert is secured within the through-hole by expanding a wall defined by and between an outer surface of the insert and the first bore. The wall is expanded by using the shaft to draw a flaring means into the first bore and into engagement with the wall so as to plastically deform the wall in a radially outward direction. The flaring means and the shaft are then removed from the insert.

An advantage of this invention is that the insert can be installed in a steam balance hole of a steam turbine rotor wheel without requiring any modifications to the wheel, and by using a procedure that avoids the risk of distorting adjacent wheels from bending stresses during the installation process, since flaring of the insert does not require pushing against adjacent wheels. Eliminating the need to press against an adjacent wheel also permits installation of the insert in the first and last wheels of a turbine section. Another advantage of the invention is an uncomplicated procedure that can be performed by an individual operator.

Other aspects and advantages of this invention will be better appreciated from the following detailed description.

DETAILED DESCRIPTION OF THE INVENTION

Figure 1:
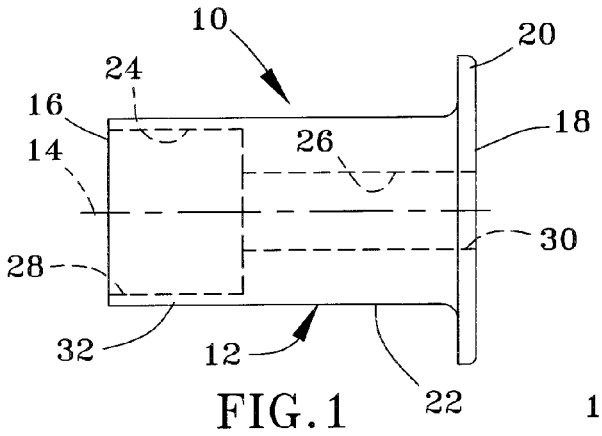
FIGS. 1 and 2 are side views of inserts configured for placement in a steam turbine wheel balance hole in accordance with embodiments of this invention.
Figure 2:
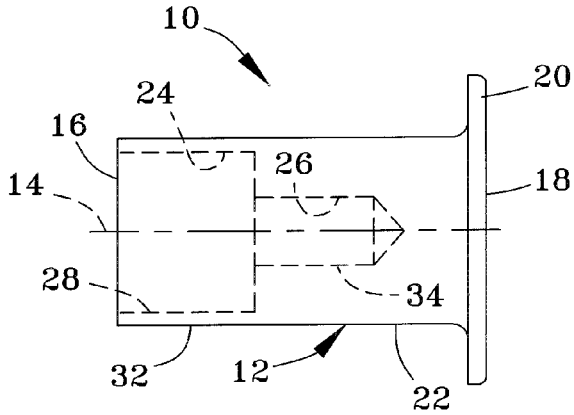
Figure 3:
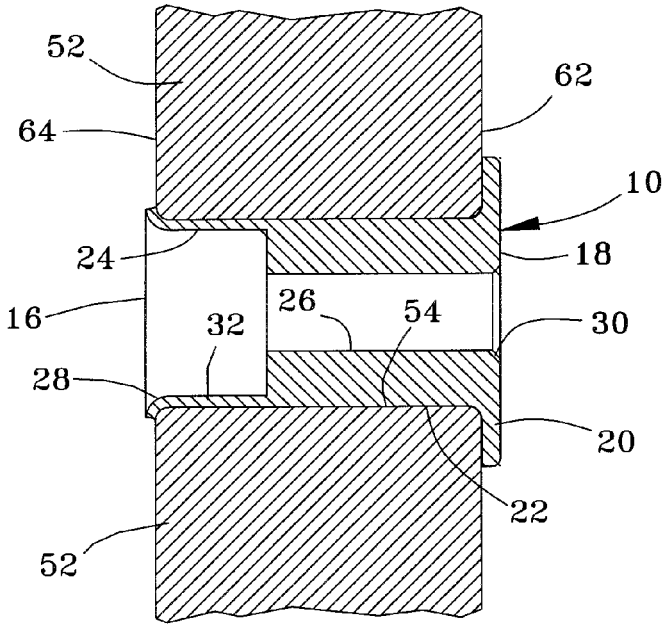
FIG. 3 is a cross-sectional view of the insert of FIG. 1 installed in a steam turbine wheel balance hole in accordance with an embodiment of this invention.
Figure 4:
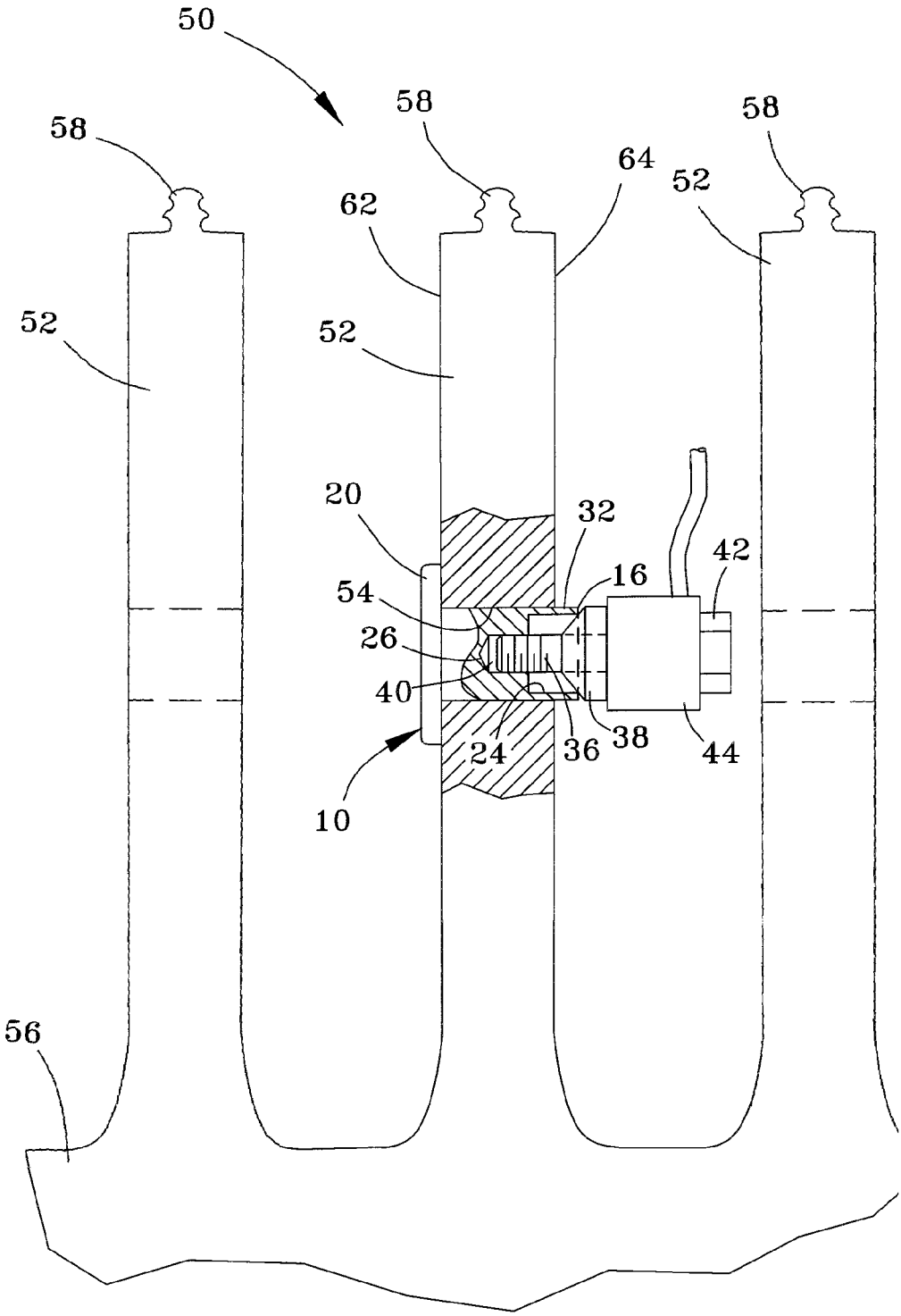
FIGS. 4 and 5 are partial cross-sectional views of steam turbine rotors and show two techniques for installing inserts of this invention in a steam turbine wheel balance hole in accordance with embodiments of this invention.
Figure 5:
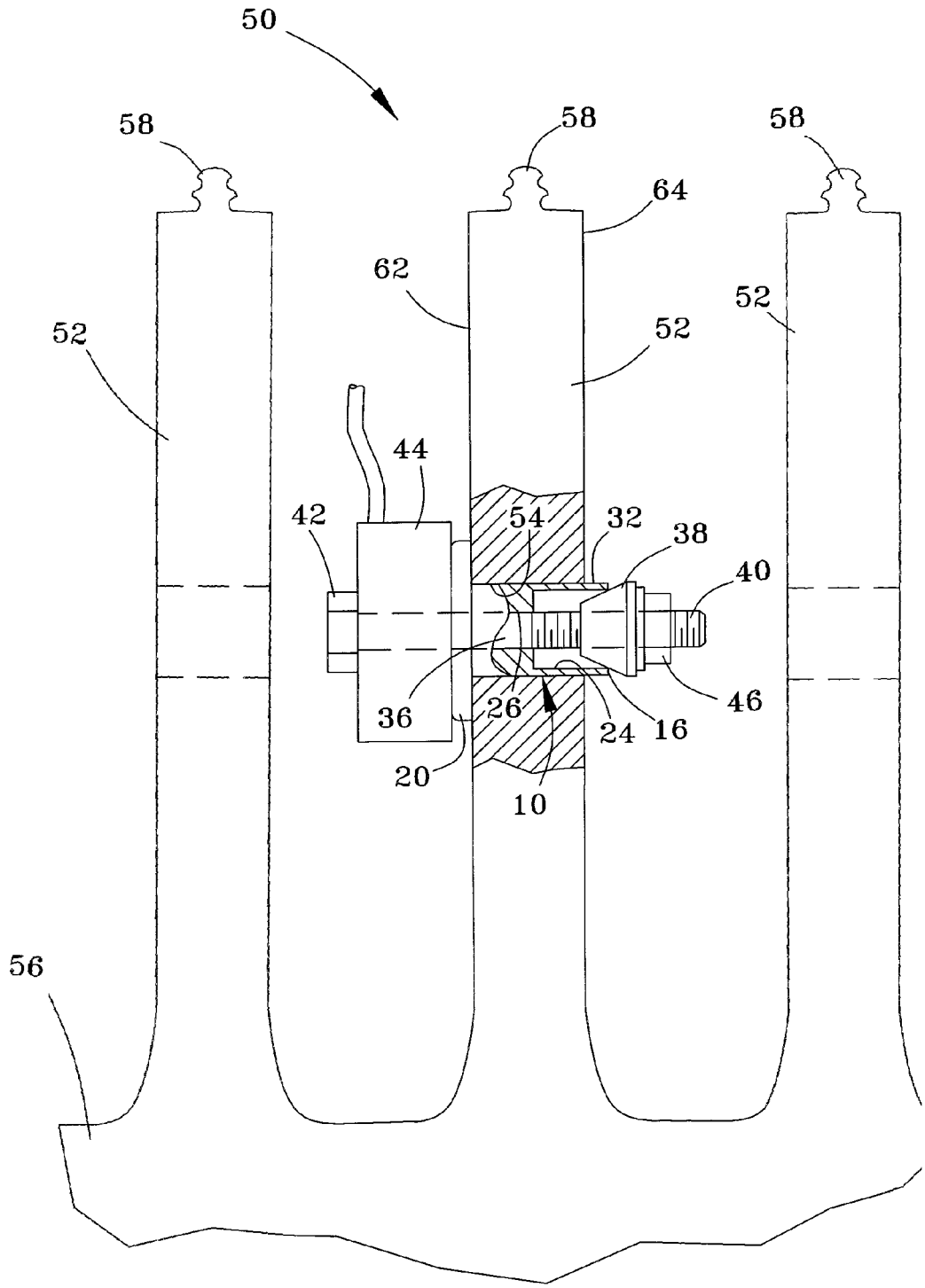

FIGS. 1 and 2 represent two embodiments of an insert 10 configured for altering a steam balance hole 54 in a steam turbine rotor wheel 52, as shown in FIG. 3. The insert 10 is intended to alter the steam balance hole 54 in the sense that it may completely plug the balance hole 54 (FIG. 4) or reduce the cross-sectional area of the balance hole 54 (FIG. 5), depending on requirements of the particular circumstances. The rotor wheel 52 is represented in FIGS. 4 and 5 as an integral part of a rotor 50 with multiple wheels 52 spaced apart along a shaft 56. The rotor 50 and its components are schematically representative of steam rotors known in the art, and are shown for the purpose of describing the invention. The particular configurations of the rotor 50 and its components are not intended to limit the scope of the invention. While the invention will be described in reference to a steam turbine rotor, it is foreseeable and within the scope of this invention that the insert 10 could be adapted for use in closing or restricting holes through other bodies, including wheels of other turbomachinery.

Each wheel 52 is shown as having a steam balance hole 54 axially aligned with balance holes 54 in the other wheels 52. Furthermore, each wheel 52 is shown with its periphery configured to have a dovetail 58 by which buckets (not shown) can be circumferentially mounted around the wheel circumference. Between each pair of adjacent wheels 52, the rotor shaft 56 is configured for sealing with stationary nozzles (not shown) disposed between the wheel pairs, such as with a brush seal or packing ring (not shown), to minimize leakage between the shaft 56 and the nozzles. When installed in a steam turbine, the rotor 50 is oriented so that faces 62 of the wheels 52 face upstream into the steam flow path, while their oppositely-disposed faces 64 face downstream, such that steam leakage flow through each balance hole 54 is from the upstream face 62 to the downstream face 64 of each wheel 52. As well understood in the art, steam from the steam flow path that leaks between the rotor shaft 56 and nozzles flows through the steam balance holes 54, so as to pass from stage to stage of the turbine preferably without rejoining the steam flow path. The balance holes 54 are typically cylindrical in shape, equally circumferentially spaced and located a specified radial distance from the axis of the rotor 50, and sized to have diameters that achieve a steam leakage flow acceptable for the particular steam turbine design. A typical size range for the balance holes 54 is believed to be about 0.75 inch to about 1.5 inches (about 2 cm to about 4 cm), though smaller and larger diameters are foreseeable and within the scope of this invention.

FIGS. 1 and 2 represent two embodiments of the insert 10. For convenience, consistent reference numbers are used throughout the drawings to identify functionally similar elements. FIGS. 1 and 2 represent the insert 10 as having a body 12 with a unitary construction, in other words, not an assembly of discretely formed pieces. The body 12 defines a longitudinal axis 14, oppositely-disposed first and second ends 16 and 18, a flange 20 radially extending from the second end 18, and an outer surface 22 at the perimeter of the body 12 between the first end 16 and the flange 20. The insert 10 can be formed of a variety of materials, for example, a stainless steel, preferred examples of which are Type 403/410 and 403Cb stainless steels though it is foreseeable that other materials could be employed. For assembly into a cylindrical-shaped balance hole 54, the insert 10 may have circular external and internal cross-sectional shapes along its entire length, and the outer surface 22 may have a substantially constant circular cross-sectional shape between the first end 16 of the insert 10 and the flange 20 at the second end 18 of the insert 10. To promote its strength, the flange 20 preferably extends radially outward from the entire perimeter of the outer surface 22 to define an outer circular edge, though a discontinuous flange 20 and other edge shapes are also within the scope of this invention. The flange 20 preferably extends a distance of about 0.375 inch (about 1 cm) or more from the outer surface 22, though lesser dimensions for the flange 20 are foreseeable and within the scope of this invention.

Suitable lengths for the insert 10 will depend on the particular geometry of the wheel 52, though lengths of about 0.25 inch (about 6 mm) longer than the axial width of the wheel 52 are believed to be particularly suitable. On this basis, insert lengths of about 1.5 to about 2.5 inches (about 4 to about 6 cm) are believed to be fairly typical.

First and second bores 24 and 26 are defined within the body 12. The first bore 24 defines a first opening 28 at the first end 16 of the body insert 10, and with the outer surface 22 defines an annular-shaped wall 32. As discussed in reference to FIGS. 3 through 5 below, the wall 32 is adapted to be plastically deformed in a radially outward direction relative to the axis 14 of the insert 10. As such, the minimum depth of the bore 24 should be sufficient to provide an amount of wall material that can be deformed in the manner shown in FIG. 3, and as such will depend on the length of the insert 10 and the axial thickness of the wheel 52.

The second bore 26 within the insert 10 communicates with the first bore 24, but has a smaller cross-section than the first bore 24. In the embodiment of FIG. 1, the second bore 26 is a through-hole and the first and second bores 24 and 26 define a continuous longitudinal passage through the insert 10. The second bore 26 defines a second opening 30 at the second end 18 of the insert 10 having a smaller cross-sectional area than the first opening 28 defined by the first bore 24. With the configuration represented in FIG. 1, the insert 10 provides a restricted orifice within the steam balance hole 54 in which it is installed, as represented in FIG. 3. A suitable cross-sectional area for the orifice (as defined by the second bore 26) will depend on the particulars of the turbine rotor 50 and the steam turbine in which it is installed. However, orifice diameters of about 0.25 inch to about 1.25 inches (about 6 mm to about 30 mm) are believed to be suitable for many applications. The second bore 26 can be drilled in the body 12 of the insert 10 to enable its orifice size to be customized to obtain a desired balance hole area for a given stage of a steam turbine.

In the embodiment of FIG. 2, the second bore 26 is a blind bore, such that the insert 10 is configured to completely plug the steam balance hole 54, instead of providing a reduced through-flow orifice as intended with the embodiment of FIG. 1. FIG. 2 shows the second bore 26 as being formed to have female threads 34 for reasons explained in reference to FIG. 4.

As evident from FIG. 3, the insert 10 of FIG. 1 has undergone plastic deformation at its first end 16 in order to permanently retain the insert 10 within the steam balance hole 54 of the wheel 52. In particular, the wall 32 defined between the first bore 24 and the outer surface 22 of the insert 10 has been plastically deformed in a radially outward direction relative to the axis 14 of the insert 10. The deformed wall 32 cooperates with the flange 20 to clamp the axial thickness of the wheel 52 therebetween. To ensure adequate structural integrity, the wall 32 preferably has a uniform thickness, preferably about 0.125 inch (about 3 mm) or greater, though lesser thicknesses could be used depending on the material of the insert 10. Furthermore, the wall 32 is preferably deformed radially outward about 0.125 inch (about 3 mm) or more. The insert 10 is shown installed so that its end 18 with the flange 20 is located on the upstream face 62 of the wheel 52, though it is foreseeable that the insert 10 could be installed to have an opposite orientation. The insert 10 of FIG. 2 is adapted to be installed in an essentially identical manner.

Because the axial spacing between adjacent wheels 52 is limited as evident from FIGS. 4 and 5, the installation of either insert 10 of this invention is preferably performed in a manner that is capable of firmly securing the insert 10 in the limited space provided. In general terms, the insert 10 is inserted in the steam balance hole 54 from the upstream face 62 of the wheel 52 so that the first end 16 of the insert 10 protrudes from the downstream face 64 of the wheel 52 and the flange 20 abuts the upstream face 62. The wall 32 at the first end 16 of the insert 10 is then flared to engage the downstream side 64 of the wheel 52, clamping the axial thickness of the wheel 52 with the flange 20. Flaring of the insert wall 32 can be performed with a shaft 36 and a flaring tool 38, as represented in FIGS. 4 and 5. The tool 38 has a conical or tapered portion sized and configured to engage and flare the insert wall 32 as the tool 38 is forced into the opening 28 of the insert 12. A suitable angular taper for the flaring tool 38 is believed to be in a range of about 50 to about 60 degrees from the axis of the flaring tool 38, though lesser and greater tapers are foreseeable and within the scope of the invention. Also foreseeable are other means capable of flaring the insert wall 32 by being forcible inserted into the first bore 24 of the insert 10. After the insert wall 32 has been flared, the shaft 36 and flaring tool 38 can be removed, leaving only the insert 10 within the balance hole 54.

For installing the insert 10 of FIG. 2 as represented in FIG. 4, the shaft 36 is generally configured as a bolt with one end 40 of the shaft 36 formed to have male threads and the opposite end 42 formed to have a head. Prior to assembling the shaft 36 with the insert 10, the flaring tool 38 is placed on the shank of the shaft 36, as is an expansion device 44 capable of forcing the flaring tool 38 toward the threaded end 40 of the shaft 36. Suitable expansion devices for this purpose include hollow hydraulic jacks commercially available, such as the ENERPAC model RCH120 hollow plunger jack. With the first end 16 of the insert 10 protruding from the balance hole 54 at the downstream face 64 of the wheel 52, the shaft 36 is inserted through the first bore 24 and its threaded end 40 is threaded into the threaded second bore 26 as shown in FIG. 4. The length of the shaft 36 is selected such that, when threaded into the threaded second bore 26 of the insert 10, the flaring tool 38 abuts the first end 16 and wall 32 of the insert 10 and the flaring tool 38, expansion device 44, and head of the shaft 36 axially abut each other or at least are sufficiently axially close to each other so that axial expansion of the device 44 is able to press the flaring tool 38 into the first bore 24 and radially expand the insert wall 32 to acquire a shape similar to that shown in FIG. 3. After the shaft 36 is removed, only the insert 10 remains within the balance hole 54. Because the second bore 26 is blind, the insert 10 completely closes/plugs the steam balance hole 54.

For installing the insert 10 of FIG. 1 as represented in FIG. 5, the shaft 36 is again shown as being generally configured as a bolt, with one end 40 of the shaft 36 formed to have male threads and the opposite end 42 formed to have a head. In contrast to FIG. 4, the shaft 36 is passed entirely through both bores 24 and 26 of the insert 10, so that the opposing ends 40 and 42 of the shaft 36 protrude at the downstream and upstream faces 64 and 62, respectively, of the wheel 52. For applications in which the desired orifice size of the second bore 26 is relatively small, for example, less than about 0.5 inch (about 1.3 cm), it may be necessary to form threads on a portion of the bore 26 and install the insert 10 in the same manner as described for FIG. 4.

Prior to assembling the shaft 36 with the insert 10, the expansion device 44 is placed on the shank of the shaft 36. With the first end 16 of the insert 10 protruding from the balance hole 54 at the downstream face 64 of the wheel 52, the threaded end 40 of the shaft 36 is inserted through the second bore 24, through the first bore 24, and out through the first opening 28 of the insert 10. The flaring tool 38 can then be assembled onto the threaded end 40 and secured with a nut 46, with the result that the nut 46, tool 38, and insert wall 32 axially abut each other or at least are sufficiently axially close to each other so that axial expansion of the device 44 is able to pull the flaring tool 38 toward the device 44 and into the first bore 24, radially expanding the insert wall 32 to acquire a shape similar to that shown in FIG. 3. After the shaft 36 is removed, only the insert 10 remains within the balance hole 54. Because the second bore 26 is a through-hole and defines a continuous passage with the first bore 24, and the second opening 30 defined by the bore 26 has a smaller cross-sectional area than the steam balance hole 54, the insert 10 defines a flow restrictor for the balance hole 54.

From the foregoing, it can be appreciated that the insert 10 of this invention can be installed using a procedure that avoids the risk of distorting adjacent turbine wheels 52 from bending stresses during the flaring process, since flaring of the insert 10 does not require pushing against an adjacent wheel 52. Eliminating the need to press against an adjacent wheel 52 also permits installation of the insert 10 in the first and last wheels 52 of a turbine section. Another advantage of the invention is that the insert 12 can be installed without disturbing or modifying the wheel 52, and installation involves an uncomplicated procedure that can be performed by an individual operator.

While the invention has been described in terms of specific embodiments, it is apparent that other forms could be adopted by one skilled in the art. For example, the physical configuration of the insert 10 and the individual components used to install the insert 10, as well as the configuration of the rotor 50, could differ from those shown in the figures, and materials and processes other than those noted could be used. Furthermore, it should be appreciated that the bolt head end 42 in FIG. 4 and the nut 46 in FIG. 5 could be used to apply sufficient force to the tool 38 to flare the insert wall 32, and therefore eliminate the need for the expansion device 44. Therefore, the scope of the invention is to be limited only by the following claims.

The invention claimed is:

1. An insert installed in and altering a through-hole that defines a steam balance hole in a steam turbine rotor wheel, the insert comprising:

a body having a unitary construction, a longitudinal axis, oppositely-disposed first and second ends, a flange radially outward extending from the second end of the body, and an outer surface at a perimeter of the body between the first end and the flange at the second end of the body;

a first bore within the body and defining a first opening at the first end of the body, the outer surface of the body and the first bore cooperating to define therebetween a wall capable of being plastically deformed in a radially outward direction; and a second bore within the body, the second bore communicating with the first bore and having a smaller cross-section than the first bore.

2. The insert according to claim 1, wherein the second bore defines a second opening at the second end of the body, the first and second bores define a continuous longitudinal passage through the body, and the second opening has a smaller cross-sectional area than the first opening.

3. An insert installed in and altering a through-hole that defines a steam balance hole in a steam turbine rotor wheel, the insert comprising:

a body having a longitudinal axis, oppositely-disposed first and second ends, a flange radially extending from the second end of the body, and an outer surface at a perimeter of the body between the first end and the flange at the second end of the body;

a first bore within the body and defining a first opening at the first end of the body, the outer surface of the body and the first bore cooperating to define therebetween a wall capable of being plastically deformed in a radially outward direction; and a second bore within the body, the second bore communicating with the first bore and having a smaller cross-section than the first bore, wherein the second bore is a blind threaded bore.

4. The insert according to claim 1, wherein the second bore defines a second opening at the second end of the body, the first and second bores define a continuous longitudinal passage through the body, and the second opening has a smaller cross-sectional area than the first opening and the steam balance hole so as to define a restricted orifice within the steam balance hole.

5. The insert according to claim 4, wherein the second bore has circular cross-section and a diameter of less than 3 millimeters.

6. The insert according to claim 1, wherein the second bore is a blind threaded bore and the insert plugs the steam balance hole.

7. The insert according to claim 1, wherein the cross-sectional shape of the outer surface of the body is cylindrical.

8. The insert according to claim 7, wherein the outer surface of the body has a diameter of less than 4 millimeters.

9. The insert according to claim 7, wherein the wall between the outer surface of the body and the first bore has a thickness of at least 0.3 millimeter.

10. A steam turbine rotor wheel having a steam balance through-hole in which the insert of claim 1 is installed.

11. A method of installing the insert of claim 1 in the through-hole of the steam turbine rotor wheel, the method comprising:

placing the insert in the through-hole so that the first end of the insert protrudes from a first side of the steam turbine rotor wheel and the flange at the second end of the insert abuts an oppositely-disposed second side of the steam turbine rotor wheel;

inserting a shaft in the first bore within the body of the insert;

securing the insert within the through-hole by expanding the wall defined by and between the outer surface of the insert and the first bore, the wall being expanded by using the shaft to draw a flaring means into the first bore and into engagement with the wall so as to plastically deform the wall in a radially outward direction; and then removing the flaring means and the shaft from the insert.

12. The method according to claim 11, wherein the first side of the steam turbine rotor wheel is a downstream side of the wheel, and the second side of the steam turbine rotor wheel is an upstream side of the wheel.

13. The method according to claim 11, wherein the inserting step comprises inserting the shaft through the first bore and securing a first end of the shaft within the second bore.

14. The method according to claim 13, wherein the first end of the shaft is secured to the second bore with complementary male and female threads.

15. The method according to claim 13, wherein a second end of the shaft protrudes from the first bore as a result of the inserting step, and the securing step comprises mounting at the second end of the shaft a means for forcing the flaring means toward the first end of the shaft.

16. The method according to claim 13, wherein the second bore is a blind bore and the insert plugs the through-hole.

17. The method according to claim 11, wherein the inserting step comprises inserting the shaft entirely through the first and second bores so that oppositely-disposed first and second ends of the shaft protrude at the first and second sides of the steam turbine rotor wheel, respectively.

18. The method according to claim 17, wherein the securing step comprises mounting the flaring means at the first end of the shaft and mounting at the second end of the shaft a means for pulling the flaring means toward the forcing means.

19. The method according to claim 18, wherein the second bore defines a second opening at the second end of the body, the first and second bores define a continuous longitudinal passage through the body, and the second opening has a smaller cross-sectional area than the first opening and the through-hole so as to define a restricted orifice within the through-hole.

* * * * *